US012324944B2

(12) United States Patent
Mitchell

(10) Patent No.: US 12,324,944 B2
(45) Date of Patent: Jun. 10, 2025

(54) EXERCISE MACHINE

(71) Applicant: Dean Mitchell, Chipley, FL (US)

(72) Inventor: Dean Mitchell, Chipley, FL (US)

( * ) Notice: Subject to any disclaimer, the term of this patent is extended or adjusted under 35 U.S.C. 154(b) by 175 days.

(21) Appl. No.: 18/320,238

(22) Filed: May 19, 2023

(65) Prior Publication Data

US 2023/0372762 A1 Nov. 23, 2023

Related U.S. Application Data

(60) Provisional application No. 63/344,065, filed on May 20, 2022.

(51) Int. Cl.

| | |
|---|---|
| ***A63B 21/068*** | (2006.01) |
| ***A63B 21/00*** | (2006.01) |
| ***A63B 21/062*** | (2006.01) |

(52) U.S. Cl.

CPC ..... *A63B 21/068* (2013.01); *A63B 21/0622* (2015.10); *A63B 21/154* (2013.01); *A63B 21/4035* (2015.10)

(58) Field of Classification Search

CPC . A63B 21/068; A63B 21/0622; A63B 21/154; A63B 21/4035; A63B 22/0005; A63B 21/4043; A63B 22/0012; A63B 23/0417; A63B 22/0605; A63B 21/00058; A63B 21/00061; A63B 21/00065; A63B 21/005; A63B 21/0051; A63B 21/0052; A63B 21/0056; A63B 21/0057; A63B 21/06; A63B 21/062; A63B 21/4045;

(Continued)

(56) References Cited

U.S. PATENT DOCUMENTS 339,638 A * 4/1886 Goldie ..... A63B 21/154 482/96
1,982,872 A * 12/1934 Husted ..... A63B 22/0087 482/72
4,272,074 A 6/1981 Mihai (Continued)

FOREIGN PATENT DOCUMENTS

DE 19909173 A1 * 9/2000 ..... A63B 21/062

OTHER PUBLICATIONS

Amazon.com: Bayou Fitness Total Trainer 4000-XL Home Gym : Sports & Outdoors; archived Aug. 29, 2014, accessed Dec. 26, 2024 (Year: 2014).*

*Primary Examiner* — Megan Anderson
*Assistant Examiner* — Juan Carlos De Leon Diaz
(74) *Attorney, Agent, or Firm* — Lewellyn Law, PLLC; Stephen Lewellyn

(57) ABSTRACT

An exercise machine has an inclined frame and a user supporting a carriage slidingly supported on the frame for movement along the frame. A cable and pulley system is operatively connected to the frame. The carriage is operable by a user supported on the carriage to move the carriage along the frame and under the resistance of the user's weight. The cable and pulley system has a pair of forward pulls and a pair of rearward pulls, each of which may be operated by the user to move the carriage along the frame. A cardiovascular exercise device, such as for example a bicycle crank assembly may be supported on the carriage for conjoined movement with the carriage, allowing a user to operate the bicycle crank and the carriage simultaneously for cardiovascular exercise and weight lifting.

19 Claims, 7 Drawing Sheets

(58) Field of Classification Search
CPC . A63B 22/0087; A63B 22/0089; A63B 22/06; A63B 2022/0635; A63B 2022/0652
See application file for complete search history.

(56) References Cited

U.S. PATENT DOCUMENTS

| | | | | |
|---|---|---|---|---|
| 4,383,684 | A * | 5/1983 | Schliep ..... | A63B 21/0628 482/133 |
| 4,911,438 | A | 3/1990 | Van Straaten | |
| 8,323,157 | B2 | 12/2012 | Campanaro | |
| 8,696,528 | B2 | 4/2014 | Campanaro | |
| 8,708,866 | B2 | 4/2014 | Spevak | |
| 8,834,332 | B2 | 9/2014 | Campanaro | |
| 9,770,622 | B2 | 9/2017 | Campanaro | |
| 11,420,090 | B2 | 8/2022 | Stepanian | |
| 11,607,582 | B2 | 3/2023 | Bentivoglio | |
| 2006/0040810 | A1 | 2/2006 | Chu | |
| 2014/0194260 | A1 | 7/2014 | Campanaro | |

* cited by examiner

EXERCISE MACHINE

REFERENCE TO RELATED APPLICATIONS

This application claims the benefit of U.S. Provisional Application Ser. No. 63/344,065, filed on May 20, 2022, the entirety of which is incorporated herein by reference.

TECHNICAL FIELD

The present invention relates to exercise devices and, more particularly, to exercise machines having a carriage slidably disposed on a support frame and for supporting a user's body weight to provide a variety of exercises.

BACKGROUND

A variety of exercise apparatuses (including stationary and non-stationary exercise machines) are in ubiquitous use today for maintaining health and fitness. Various equipment provides functionalities that allow a user to engage in specific activities. If a user likes to engage in various exercises, it may become necessary to purchase or to have access to multiple different machines to be able to engage in various activities. However, in commercial and residential applications, floor space may be limited. Accordingly, there is a desire for an exercise apparatus for exercising a broad range of specific muscles with a single device while providing the ability for simultaneous cardiovascular exercise as well.

SUMMARY

Accordingly, it is a general object of embodiments of the present invention to provide a new exercise machine that can exercise a broad range of specific muscles with a single device and to provide the ability for simultaneous cardiovascular exercise.

Another object of embodiments of the present invention is to provide an exercise machine having a sliding carriage that supports a user and uses the user's weight in resistance exercise.

Another object of embodiments of the present invention is to provide an exercise machine having a new cable and pulley system that includes forward pulls and rearward pulls for sliding the carriage and a double pulley configuration that operatively connects the forward pulls and the rearward pulls.

Another object of embodiments of the present invention is to provide an exercise machine that can use plate weights to increase resistance.

Another object of embodiments of the present invention is to provide an exercise machine that is easy to operate and provides numerous different exercises.

In an aspect, an exercise machine is provided. The exercise machine has a frame with forward and reward ends and being inclined in a direction from the forward end toward the rearward end. A carriage is slidingly supported on the frame for longitudinal movement along the frame between the forward and rearward ends. A cable and pulley system is operatively connected to the frame and carriage assembly and is operable by a user supported on the carriage to move the carriage along the frame. The cable and pulley system may include forward pulls and rearward pulls. The forward pulls may have two forward handles and one or more forward pull cables to which the two forward handles are connected. The rearward pulls may have two rearward handles and one or more rearward pull cables to which the two rearward handles are connected. At least one forward pull cable may be operatively connected to the carriage, at least one rearward pull cable may be operatively connected to the carriage, at least one forward pull cable and at least one rearward pull cable may be operatively connected such that tension is always present in the one or more forward pull cables and the one or more rearward pull cables.

In aspects, the cable and pulley system further may have first and second double pulleys. At least one forward pull cable may be wound about a forward pulley of the first double pulley, and at least one forward pull cable may be wound about a forward pulley of the second double pulley. At least one rearward pull cable may be wound about a rearward pulley of the first double pulley, and at least one rearward pull cable may be wound about a rearward pulley of the second double pulley.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings.

DETAILED DESCRIPTION

Figure 1:
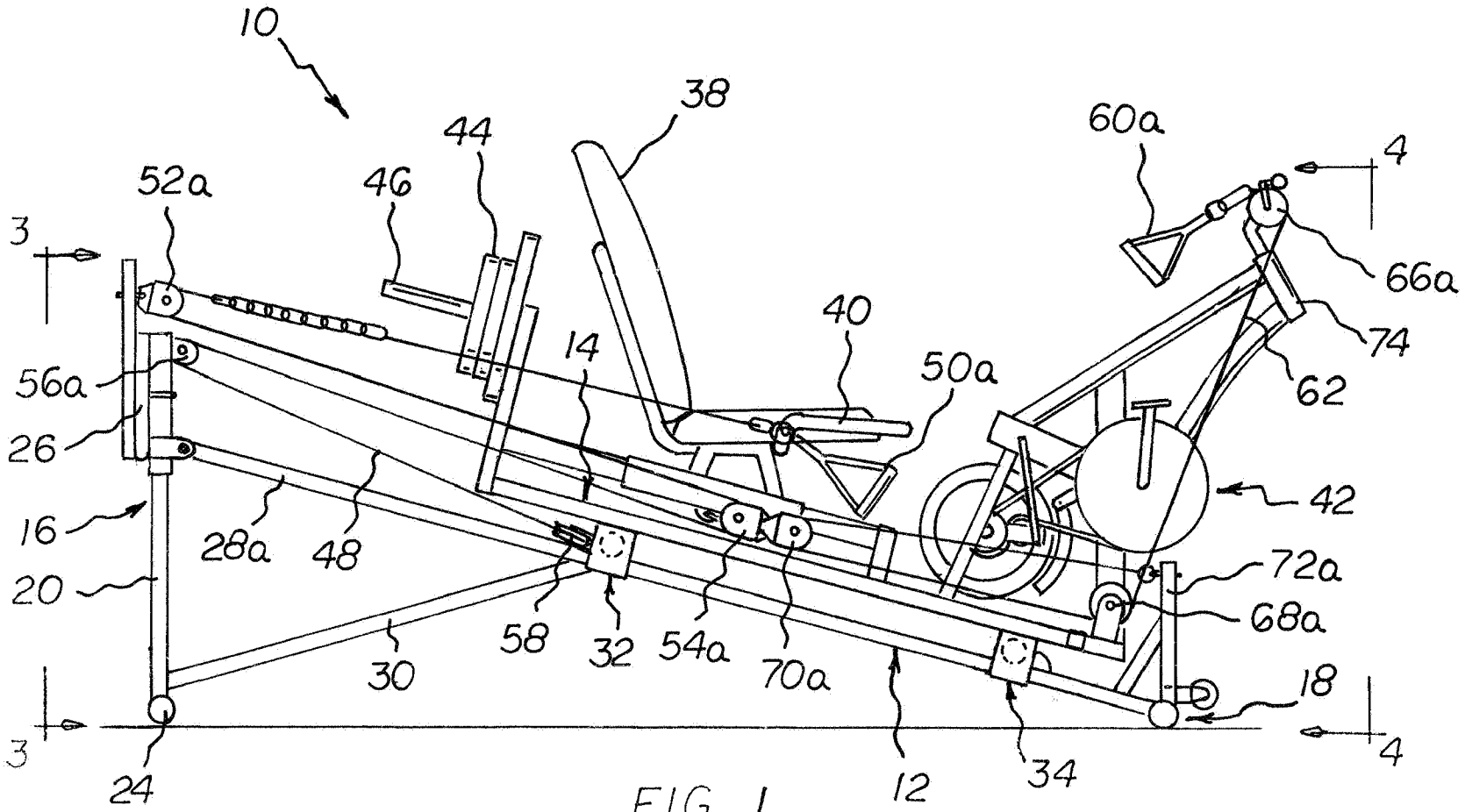
FIG. 1 is a side view of an exercise machine constructed in accordance with an embodiment of the invention.
Figure 2:
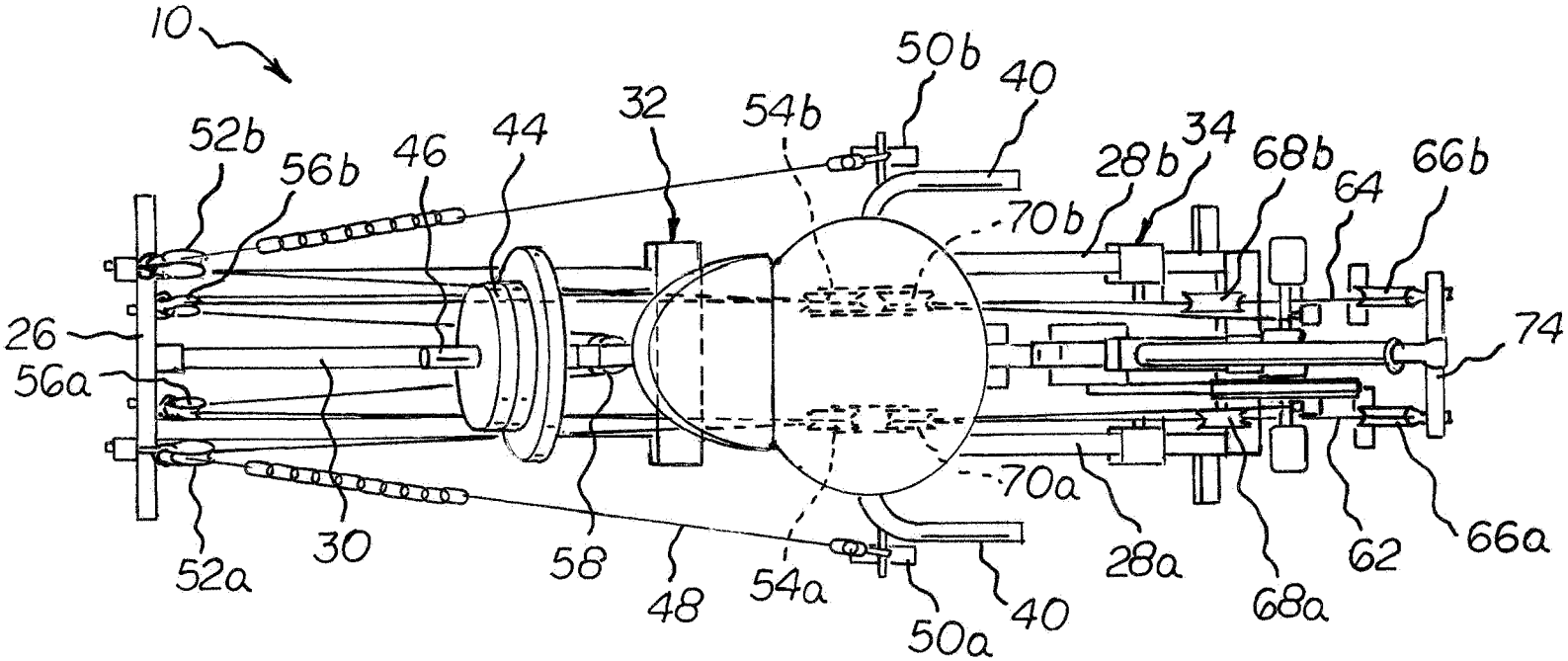
FIG. 2 is a top view of the exercise machine.
Figure 3:
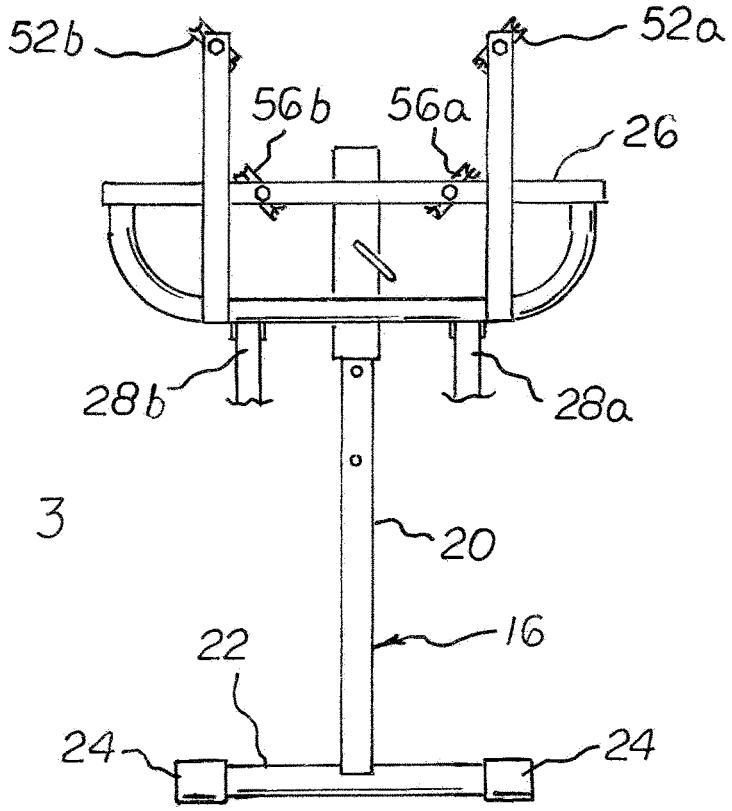
FIG. 3 is partial back view of the exercise machine, taken generally along line 3-3 in FIG. 1.
Figure 4:
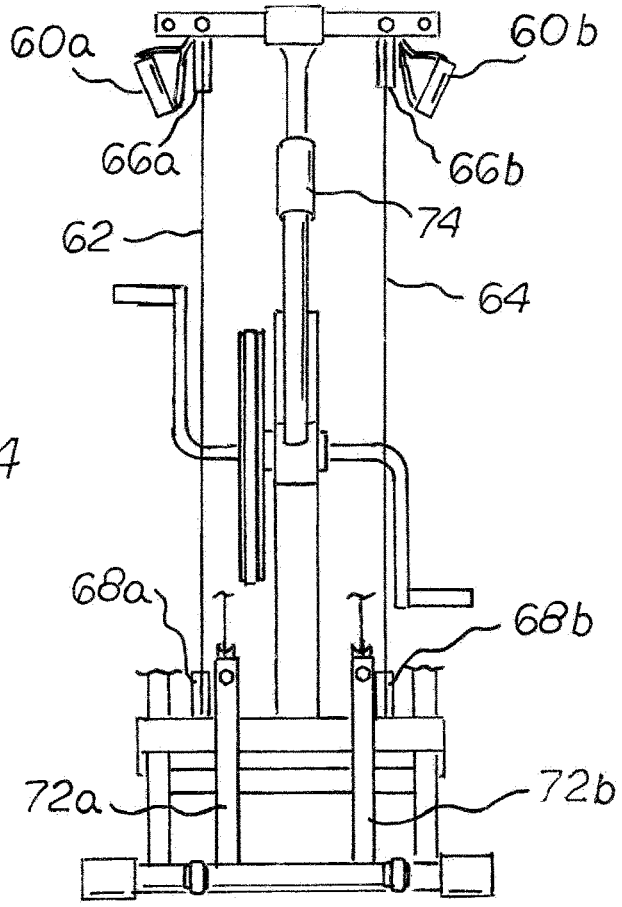
FIG. 4 is partial front view of the exercise machine, taken generally along line 4-4 in FIG. 1.
Figure 5:
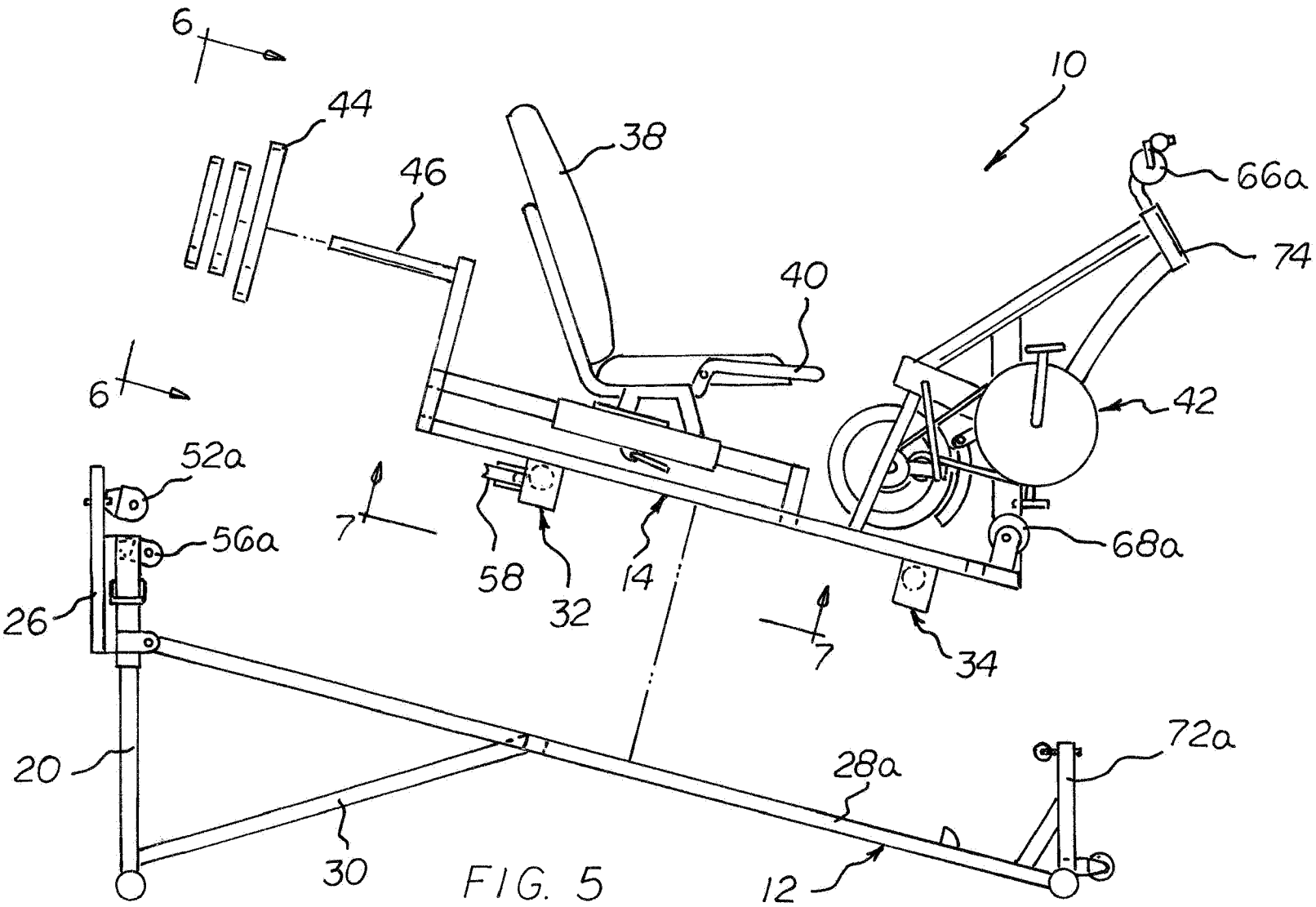
FIG. 5 is a partial exploded view of the exercise machine.
Figure 6:
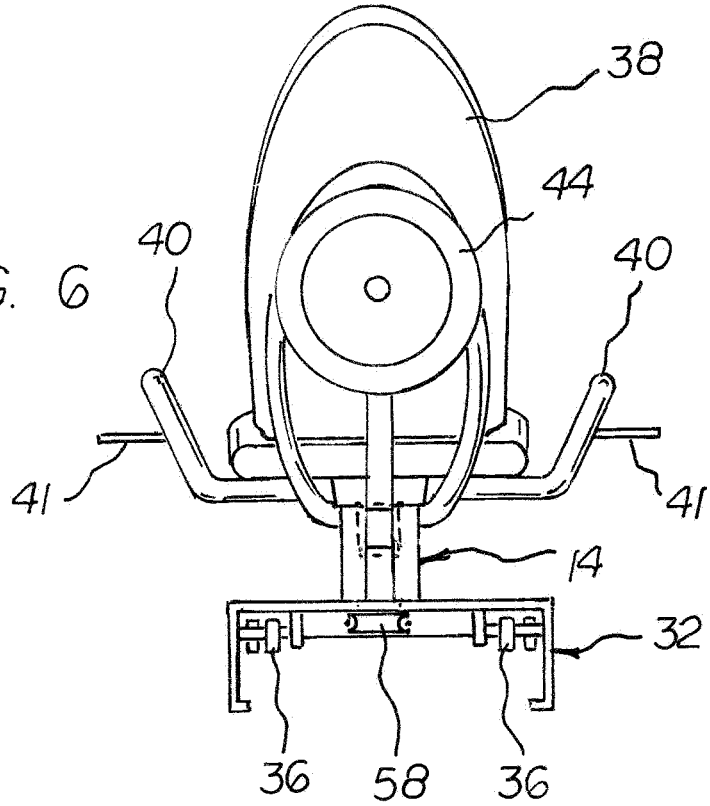
FIG. 6 is a partial back view of a carriage of the exercise machine, taken generally along line 6-6 in FIG. 5.
Figure 7:
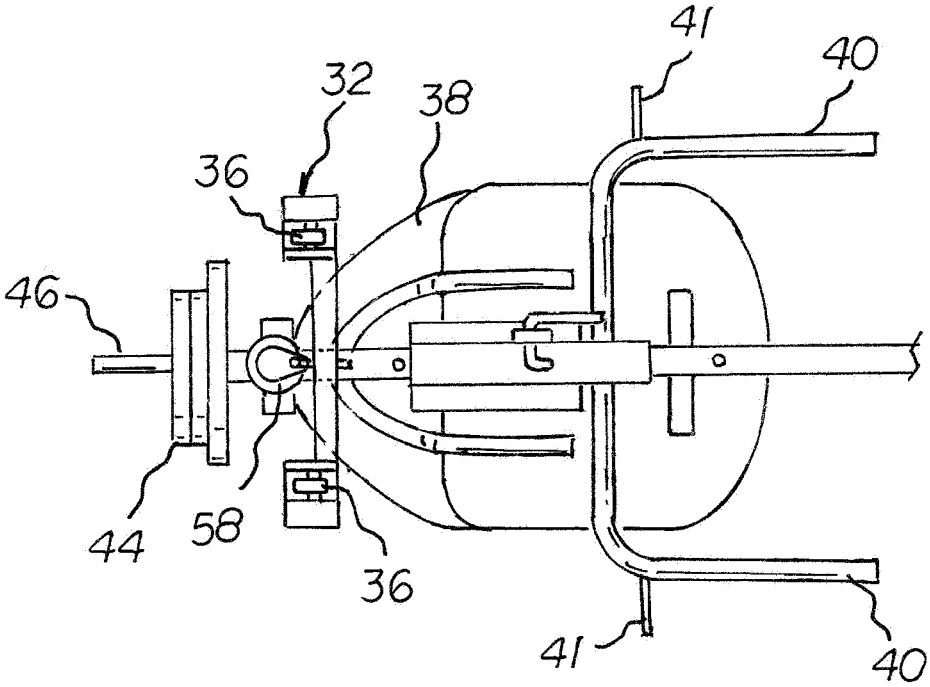
FIG. 7 is a partial bottom view of a carriage of the exercise machine, taken generally along line 7-7 in FIG. 5.

Initially, with reference to FIGS. 1-7, there is illustrated an exercise machine 10 that is constructed in accordance with a least one embodiment of the invention. Machine 10 has a frame 12 and a carriage 14 that is slidably supported on the frame for longitudinal movement along the frame between its forward and rearward ends. As described in further detail below, machine 10 includes a cable and pulley system that is operated by a user sitting on the carriage 14 for moving the carriage back-and-forth on the frame to perform various exercises using the user's body weight and/or additional weights attached to the carriage. The carriage 12 may also support various cardiovascular or the like exercise equipment to be used by the user while simultaneously moving the carriage or with the carriage stationary.

As shown, in the depicted embodiment, the frame 12 has a rear leg assembly 16 and a front leg assembly 18. The rear leg assembly 16 has a vertical post 20 that extends upwardly from a horizontal foot 22 that has foot pads 24 on its opposite ends. A fixture 26 is slidably attached to the vertical post 20 for movement up and down the post. The fixture 26 is configured to releasably engage with the vertical post 20 to selectively position the fixture relative to the post to adjust the height of the fixture on the post. The frame 12 further includes a pair of rails 28*a* and 28*b*. Each rail 28*a* and 28*b* is connected at one end to the fixture 26 and at the opposite, second end to the front leg assembly 18 and extends therebetween. A frame member 30 is attached at one end to the bottom of the post 20 and is attached at its opposite end to a cross-member extending between and attached to the rails 28*a* and 28*b* and provides support to the rails.

The frame 12 is configured so that the rails 28*a* and 28*b* are inclined in a direction from the front leg assembly 18 toward the rear leg assembly 16. The degree of inclination can be adjusted by raising and lowering the fixture 26 on the post 20. Raising the fixture 26 increases the inclination and lowering the fixture decreases the inclination.

The carriage 14 is slidably supported on the rails 28*a* and 28*b* for longitudinal movement along the rails between the front and rearward ends of the frame 12. In the depicted embodiment, the carriage 14 has two roller assemblies 32 and 34, one attached toward the back of the carriage, and one attached toward the front of the carriage. Each roller assembly 32 and 34 has a plurality of roller wheels 36 and is configured such that the roller wheels engage the rails 28*a* and 28*b* and provide rolling support to the carriage 12 for rolling along the rails.

A user seat 38 is attached to the carriage 12 for movement with the carriage as it slides or rolls back-and-forth along the rails 28*a* and 28*b*. A shown, the seat 38 may have a seat back and seat grips 40 on either side of the seat. The seat 38 may be movably supported on the carriage for selectively adjusting its fixed position on the carriage relative to the front and rear ends of the carriage.

The front end of the carriage 14 is configured to support various exercise equipment thereon for movement with the carriage along the rails 28*a* and 28*b*. As shown, a bicycle crank assembly 42 is attached to the carriage and is configured to provide a recumbent stationary bicycle to a user who is seated in the seat 38. As in typical stationary bicycle assemblies, the depicted assembly may have a resistance mechanism that is operable to apply a variable resistance to pedaling.

Further, in the depicted embodiment, the rear end of the carriage 14 is configured to removably support weight plates 44 thereon. As shown, a post 46 extends from the rear end of carriage 14 and is configured to removably hold one or more weight plates 44 as desired by a user of the machine.

Machine 10 further includes a pulley and cable system that is operatively connected to the carriage 12 and configured to allow the user to perform various exercises by the user pulling on the cables to move the carriage along the rails 28*a* and 28*b*. The pulley and cable system can be configured to have forward pulls that allows a user to perform exercises like curls, rows, etc. The pulley and cable system can be configured to have rearward pulls that allows a user to perform exercises like chest presses, chest flys, etc.

The pulley and cable system can include a rearward pull configuration having a first cable 48 that is wound on various pulleys and is fitted with handles 50*a* and 50*b* that are attached to opposite ends of the first cable and provide for rearward pulls. The handles 50*a* and 50*b* can be held removably attached to opposite sides of the seat 38 to position the handles for grasping by a user seated in the seat. As shown, the handles 50*a* and 50*b* could be temporarily held in place by hangers or stubs 41 extending outwardly from each seat handle 40.

The first cable 48 is wound, taken in a direction from the first from handle 50*a* to the second handle 50*b*, about pulley 52*a*, pulley 54*a*, pulley 56*a*, pulley 58, pulley 56*b*, pulley 54*b*, and then pulley 52*b*. Pulleys 52*a*, 52*b* and pulleys 56*a*, 56*b* are supported on the fixture 26, and pulley 58 is attached to the carriage 12.

The pulley and cable system can include a forward pull configuration having handles 60*a* and 60*b* that are attached to a second cable 62 and a third cable 64, respectively. More particularly, starting from handle 60*a*, the second cable 62 is wound about pulley 66*a*, pulley 68*a*, and pulley 70*a* and then its end is attached to a vertical post 72*a* attached to the front leg assembly 18. Similarly, starting from handle 60*b*, the third cable 64 is wound about pulley 66*b*, pulley 68*b*, and pulley 70*b* and then its end is attached to a vertical post 72*b* attached to the front leg assembly 18. Pulleys 66*a* and 66*b* are supported at an elevated forward position on the frame 12 by fixture 74, which positions handles 60*a* and 60*b* in position for grasping by a user.

Importantly, pulleys 54*a* and 70*a* are connected and form a first double pulley and pulleys 54*b* and 70*b* are connected and form a second double pulley. The first and second double pulleys operatively connect cable 48 to cables 62 and 64. Additionally, the first and second double pulleys are not fixedly connected to either the frame 12 nor the carriage 14, rather these pulleys are supported by tension in cables 48, 62 and 64 and are located generally on opposite sides of the frame.

Figure 8:
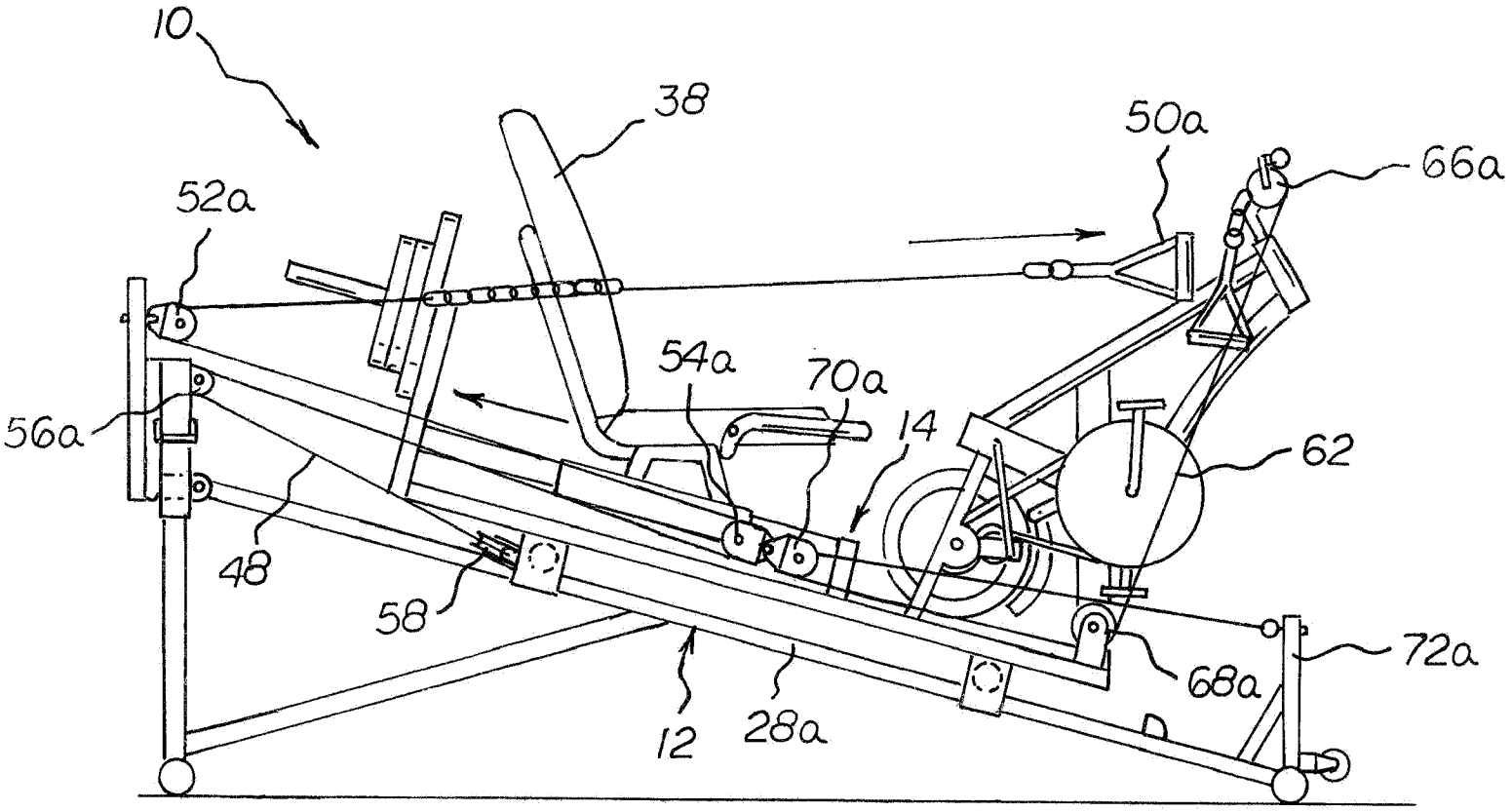
FIG. 8 is a side view of the exercise machine shown in use in a first use configuration.

With reference to FIG. 8, the exercise machine 10 is shown in operation when the rearward pull handles 50*a* and 50*b* are pulled by a user. As shown, pulling upon handles 50*a* and 50*b*, which are attached to opposite ends of cable 48, shortens the length of cable 48 between pulleys 56*a*, 56*b* and 58 and, thus, causes a rearwardly directed pulling force to be applied to the carriage 12 via the attachment of pulley 58 therewith.

Figure 9:
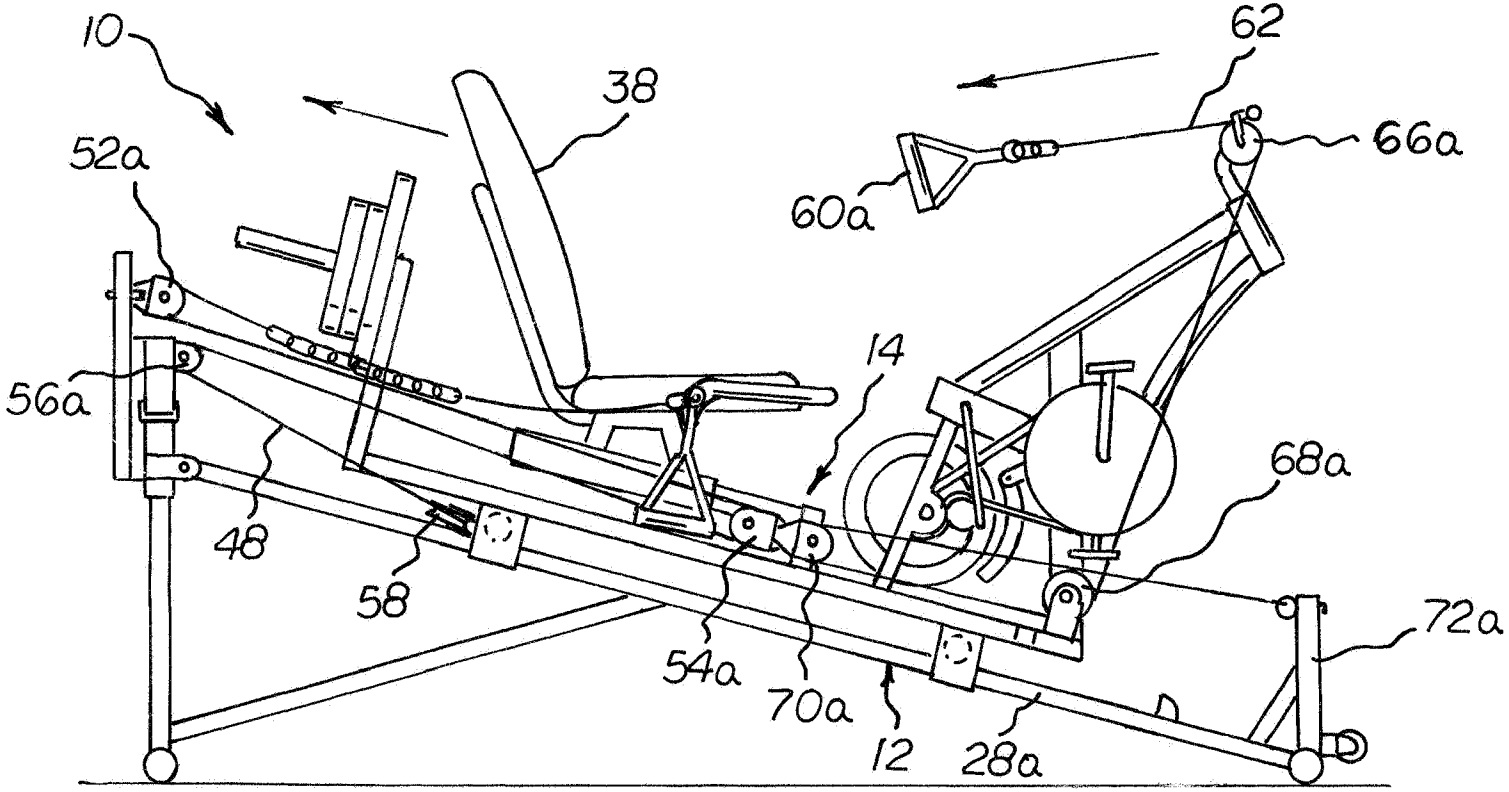
FIG. 9 is a side view of the exercise machine shown in use in a second use configuration.

With reference to FIG. 9, the exercise machine 10 is shown in operation when the forward pull handles 60*a* and

60*b* are pulled by a user. As shown, pulling upon handles 60*a* and 60*b* causes the length of cables 62 and 64 between pulleys 68*a*, 68*b* and 70*a*, 70*b* to shorten, which in turn causes the first and second double pulleys to be pulled in a direction toward the front of the frame 12. When the first and second double pulleys are pulled toward the front of the frame 12, the length of cable 48 between pulleys 56*a*, 56*b* and 58 is shortened, which causes a rearwardly directed pulling force to be applied to the carriage 12 via the attachment of pulley 58 therewith.

By either using the forward pulls or the rearward pulls, the user's weight plus any weight added by the plate weights 44 provides the resistance to the user in pulling himself or herself via the carriage 14 upward and downward the inclined frame 12 while performing various exercises. Weight can be added or removed to adjust the resistance or difficulty of the exercise. The resistance or difficulty can also be changed by either increasing or decreasing the degree of inclination of the rails 28*a* and 28*b* of the frame 12. Further, while not particularly shown in FIGS. 8 and 9, in operation a user could be pedaling the bicycle assembly 42 while operating either the forward or rearward pulls to get a full body workout simultaneously.

As mentioned above, the bicycle assembly 42 could be replaced by various other exercise equipment types as desired by the user. As a non-limiting example, an elliptical assembly, pedals with a hand lever action, or an inclined foot rest platform that would extend vertically upward from the carriage at a slight angle away from the seat could be used in place of the bicycle assembly.

While the invention has been particularly shown and described with respect to the illustrated embodiments thereof, it will be understood by those skilled in the art that the foregoing and other changes in form and details may be made therein without departing from the spirit and scope of the invention.

What is claimed is:

1. An exercise machine comprising:

a frame having forward and rearward ends, the frame being inclined in a direction from the forward end toward the rearward end;

a carriage slidingly supported on the frame for longitudinal movement along the frame between the forward and rearward ends;

a cable and pulley system operatively connected to the frame and carriage and operable by a user supported on the carriage to move the carriage along the frame, the cable and pulley system having forward pulls and rearward pulls;

the forward pulls having two forward handles and one or more forward pull cables to which the two forward handles are connected;

the rearward pulls having two rearward handles and one or more rearward pull cables to which the two rearward handles are connected;

wherein at least one of the one or more forward pull cables is operatively connected to the carriage, at least one of the one or more rearward pull cables is operatively connected to the carriage, and wherein the at least one forward pull cable and the at least one rearward pull cable are operatively connected such that tension is always present in the one or more forward pull cables and the one or more rearward pull cables; and the cable and pulley system further has first and second double pulleys;

wherein the at least one forward pull cable is wound about a forward pulley of the first double pulley, and the at least one forward pull cable is wound about a forward pulley of the second double pulley; and wherein the at least one rearward pull cable is wound about a rearward pulley of the first double pulley, and the at least one rearward pull cable is wound about a rearward pulley of the second double pulley.

2. The exercise machine of claim 1, further comprising:

a seat attached to the carriage.

3. The exercise machine of claim 2, wherein the seat is slidingly attached to the carriage to be selectively positioned along the carriage.

4. The exercise machine of claim 1, wherein:

the frame further has a front leg assembly, a rear leg assembly, and first and second rails each connected at a first end to the front leg assembly and at a second end to the rear leg assembly, the first and second rails being parallel and spaced laterally; and wherein the carriage is sliding supported on the first and second rails.

5. The exercise machine of claim 4, wherein:

the rear leg assembly has a post and a fixture slidably attached to the post for selective positioning thereal-ong; and wherein the second ends of the first and second rails are attached to the fixture.

6. The exercise machine of claim 1, further comprising:

a bicycle crank assembly attached to the carriage for conjoined movement with the carriage.

7. The exercise machine of claim 1, further comprising:

a weight post attached to the carriage and configured to removably receive and hold one or more weight plates.

8. The exercise machine of claim 1, wherein the inclination of the frame is adjustable.

9. An exercise machine comprising:

a frame having forward and rearward ends, the frame being inclined in a direction from the forward end toward the rearward end;

a carriage slidingly supported on the frame for longitudinal movement along the frame between the forward and rearward ends;

a cable and pulley system operatively connected to the frame and carriage and operable by a user supported on the carriage to move the carriage along the frame, the cable and pulley system having forward pulls and rearward pulls, and first and second double pulleys;

the forward pulls having first and second forward handles and first and second forward pull cables, the first forward handle attached to a first end of the first forward pull cable and a second end of the first forward pull cable attached to the frame at its forward end, the first forward pull cable being wound about a forward pulley of the first double pulley, the second forward handle attached to a first end of the second forward pull cable and a second end of the second forward pull cable attached to the frame at its forward end, the second forward pull cable being wound about a forward pulley of the second double pulley;

the rearward pulls having first and second rearward handles and one or more rearward pull cables, the first rearward handle attached at one end of a first rearward pull cable and the second rearward pull handle attached at a second end of the first rearward pull cable, the first rearward pull cable being wound through one or more rearward pulleys attached to the frame at its rearward end, through one or more carriage pulleys attached to the carriage, through a rearward pulley of the first double pulley and a rearward pulley of the second double pulley; and wherein tension is always present in one or both of the first and second forward pull cables and in the first rearward pull cable.

10. The exercise machine of claim 9, further comprising:

a seat attached to the carriage.

11. The exercise machine of claim 10, wherein the seat is slidingly attached to the carriage to be selectively positioned along the carriage.

12. The exercise machine of claim 9, wherein:

the frame further has a front leg assembly, a rear leg assembly, and first and second rails each connected at a first end to the front leg assembly and at a second end to the rear leg assembly, the first and second rails being parallel and spaced laterally; and wherein the carriage is sliding supported on the first and second rails.

13. The exercise machine of claim 12, wherein:

the rear leg assembly has a post and a fixture slidably attached to the post for selective positioning thereal-ong; and wherein the second ends of the first and second rails are attached to the fixture.

14. The exercise machine of claim 9, further comprising:

a bicycle crank assembly attached to the carriage for conjoined movement with the carriage.

15. The exercise machine of claim 9, further comprising:

a weight post attached to the carriage and configured to removably receive and hold one or more weight plates.

16. An exercise machine comprising:

a frame having forward and rearward ends, the frame being inclined in a direction from the forward end toward the rearward end, the frame further having a front leg assembly, a rear leg assembly, and first and second rails each connected at a first end to the front leg assembly and at a second end to the rear leg assembly, the first and second rails being parallel and spaced laterally;

a carriage slidingly supported on first and second rails for longitudinal movement along the frame between the forward and rearward ends;

a seat attached to the carriage;

a cable and pulley system operatively connected to the frame and carriage and operable by a user supported on the carriage to move the carriage along the frame, the cable and pulley system having forward pulls and rearward pulls, and first and second double pulleys;

the forward pulls having first and second forward handles and first and second forward pull cables, the first forward handle attached to a first end of the first forward pull cable and a second end of the first forward pull cable attached to the frame at its forward end, the first forward pull cable being wound about a forward pulley of the first double pulley, the second forward handle attached to a first end of the second forward pull cable and a second end of the second forward pull cable attached to the frame at its forward end, the second forward pull cable being wound about a forward pulley of the second double pulley;

the rearward pulls having first and second rearward handles and one or more rearward pull cables, the first rearward handle attached at one end of a first rearward pull cable and the second rearward pull handle attached at a second end of the first rearward pull cable, the first rearward pull cable being wound through one or more rearward pulleys attached to the frame at its rearward end, through one or more carriage pulleys attached to the carriage, through a rearward pulley of the first double pulley and a rearward pulley of the second double pulley; and wherein tension is always present in one or both of the first and second forward pull cables and in the first rearward pull cable.

17. The exercise machine of claim 16, further comprising:

a bicycle crank assembly attached to the carriage for conjoined movement with the carriage.

18. The exercise machine of claim 16, further comprising:

a weight post attached to the carriage and configured to removably receive and hold one or more weight plates.

19. The exercise machine of claim 16, wherein:

the rear leg assembly has a post and a fixture slidably attached to the post for selective positioning thereal-ong; and wherein the second ends of the first and second rails are attached to the fixture.

* * * * *